US006905049B1

(12) United States Patent
Lambert

(10) Patent No.: US 6,905,049 B1
(45) Date of Patent: Jun. 14, 2005

(54) DEVICE AND ASSEMBLY FOR DISPENSING A FLUID

(75) Inventor: Claude Lambert, Saint-Cloud (FR)

(73) Assignee: QUALIPAC, Neuilly-sur-Seine (FR)

( * ) Notice: Subject to any disclaimer, the term of this patent is extended or adjusted under 35 U.S.C. 154(b) by 90 days.

(21) Appl. No.: 10/859,163

(22) Filed: Jun. 3, 2004

(30) Foreign Application Priority Data

May 6, 2004 (FR) ..... 04 04905

(51) Int. Cl.[7] ..... B65D 88/54
(52) U.S. Cl. ..... 222/321.7; 222/321.9; 222/402.13; 239/331
(58) Field of Search ..... 239/329, 331, 239/333, 349, 360; 222/402.1, 402.13, 321.1, 222/321.7, 321.8, 321.9

(56) References Cited

U.S. PATENT DOCUMENTS

| | | | | |
|---|---|---|---|---|
| 3,058,626 A | | 10/1962 | Hibbs et al. | |
| 3,194,447 A | * | 7/1965 | Brown | 222/321.9 |
| 3,216,625 A | * | 11/1965 | Corsette | 222/182 |
| 3,471,065 A | * | 10/1969 | Malone | 222/321.1 |
| 3,680,790 A | * | 8/1972 | Boris | 239/353 |
| 3,776,413 A | | 12/1973 | Myers | |
| 3,785,528 A | * | 1/1974 | Mandeltort | 222/148 |
| 3,792,802 A | * | 2/1974 | Gores | 222/402.13 |
| 4,454,964 A | * | 6/1984 | Sacher | 222/43 |
| 5,025,941 A | | 6/1991 | Petit | |
| 5,732,855 A | * | 3/1998 | van der Heijden | 222/402.12 |
| 6,089,410 A | | 7/2000 | Ponton | |
| 6,334,271 B1 | | 1/2002 | Su Yeh | |
| 6,338,424 B2 | * | 1/2002 | Nakamura et al. | 222/402.13 |

FOREIGN PATENT DOCUMENTS

| | | |
|---|---|---|
| GB | 1 469 729 | 4/1977 |
| JP | 2002-200372 | 7/2002 |

* cited by examiner

*Primary Examiner*—Christopher Kim
(74) *Attorney, Agent, or Firm*—Young & Thompson

(57) ABSTRACT

Device comprising a push-button (8), a base element (16) and a cap (10). The push-button (8) is intended to activate a pump (6). The base element (16) is intended to be fixed to the neck (20) of a bottle (4). The cap (10) comprises a sleeve (12) and a membrane (14). The sleeve (12) is made of rigid plastics material, is fixed to the base element (16) and has a tubular portion (22) which extends in an extension direction (30). The membrane (14) is made of elastomer material, is substantially in the form of a disc and extends substantially perpendicularly to the extension direction (30) in the immediate vicinity of the push-button. The membrane has a peripheral edge (28) which is fixed to the sleeve (12) in a sealing manner. The cap defines a cavity (32) which encloses the base element (16) and the push-button (8).

8 Claims, 1 Drawing Sheet

DEVICE AND ASSEMBLY FOR DISPENSING A FLUID

BACKGROUND OF THE INVENTION

The invention relates to a device which is intended to be fixed to a neck of a bottle in order to dispense a fluid, in particular a cosmetic fluid, such as perfume.

The invention is intended to provide a simple device which comprises a smaller number of parts, which is robust and which has a refined appearance.

SUMMARY OF THE INVENTION

To this end, according to the invention, the device comprises:

a push-button which is intended to activate a pump, a base element which is intended to be fixed to the neck of the bottle, a cap comprising:

a sleeve of rigid plastics material, which sleeve is fixed to the base element and which has a tubular portion which extends in an extension direction between a lower end and an upper end, the tubular portion of the sleeve having, perpendicularly to the extension direction, an opening which is intended to allow the fluid which originates from the push-button to pass through, and a membrane of elastomer material, which membrane is substantially in the form of a disc and which extends substantially perpendicularly to the extension direction in the immediate vicinity of the push-button, said membrane having a peripheral edge which is fixed to the sleeve in a sealing manner in the vicinity of the upper end of said tubular portion, in such a manner that the cap defines a cavity, said cavity enclosing the base element and the push-button.

In this manner, the cap constitutes a unitary housing which is substantially sealed, which allows the usual interstices in which dirt accumulates to be prevented.

In order to facilitate the production of the device, according to the invention, the device has the following features:

the push-button comprises:

a substantially cylindrical base which extends in an extension direction between a lower end and an upper end, and a nozzle which extends substantially perpendicularly to the extension direction into the opening, said base element has a passage which receives the base of the push-button, the membrane has an outer face which is intended to receive the finger of a user and an inner face which is opposite the base of the push-button and the membrane is provided with guiding elements which protrude on the inner face and which extend around the base of the push-button.

In this manner, the push-button is held completely by the base element and the cap, in such a manner that the device can be produced and assembled on the premises of a first manufacturer and can then be transported to the premises of a second manufacturer in order to be mounted on a bottle and a pump, all the elements which constitute the device remaining held together completely.

According to another advantageous feature according to the invention, the membrane is overmolded on the sleeve.

In this manner, at the same time as the membrane is produced, it is fixed to the sleeve in a sealing and durable manner.

In order to further improve the appearance of the device, according to the invention, the sleeve is substantially transparent and the base element has a substantially cylindrical covering surface which extends opposite the sleeve.

In this manner, the covering surface can be covered with a decoration which is visible through the sleeve but which is protected by said sleeve.

Furthermore, the device advantageously has a tubular space between the sleeve and the covering surface, in which tubular space a decorative strip is arranged.

In this manner, the decoration which covers the covering surface can be readily modified at low cost.

According to another feature according to the invention, the sleeve has an annular beading and the base element is held between the rim of the sleeve and the annular beading.

In this manner, the sleeve can readily be fixed to the base element.

The invention also relates to an assembly which comprises, in addition to the aforementioned device, a bottle which comprises a neck and a cylindrical container which extends between a lower end and an upper end, and a pump which is held on the neck of the bottle and which has an activation rod.

According to the invention, the push-button is mounted on the activation rod, the base element is fixed to the neck and the tubular portion of the sleeve extends in the extension of the container, the tubular portion of the sleeve extending flush with the cylindrical container, the lower end of the tubular portion of the sleeve extending in the immediate vicinity of the upper end of the container.

BRIEF DESCRIPTION OF THE DRAWINGS

The invention will be appreciated even more clearly from the following description given with reference to the appended drawings, in which.

DETAILED DESCRIPTION OF THE PREFERRED EMBODIMENT

Figure 1:
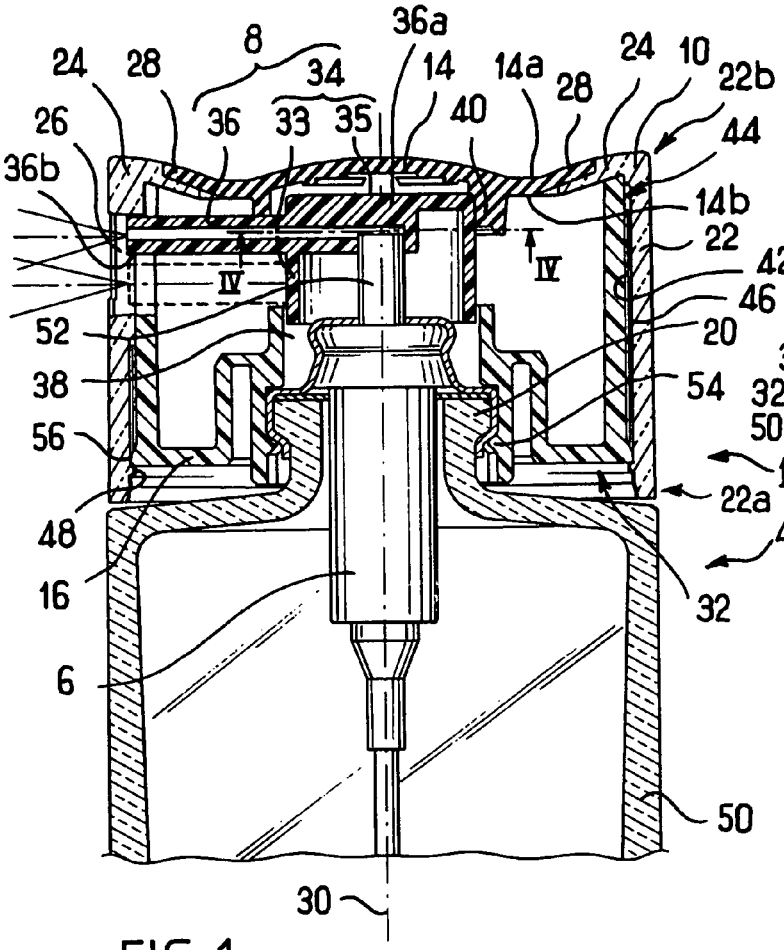
FIG. 1 is a central sectioned view of an assembly according to the invention which comprises a device according to the invention.
Figure 2:
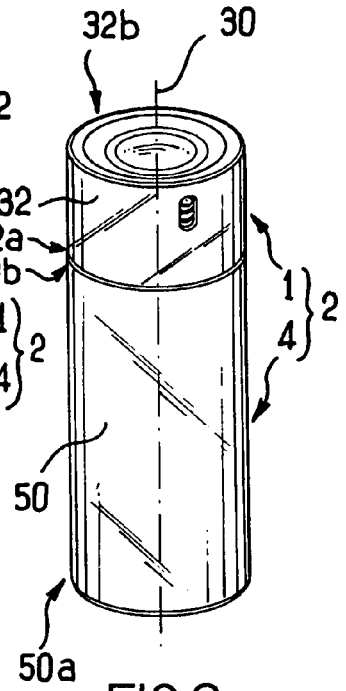
FIG. 2 is a perspective view of the assembly.
Figure 3:
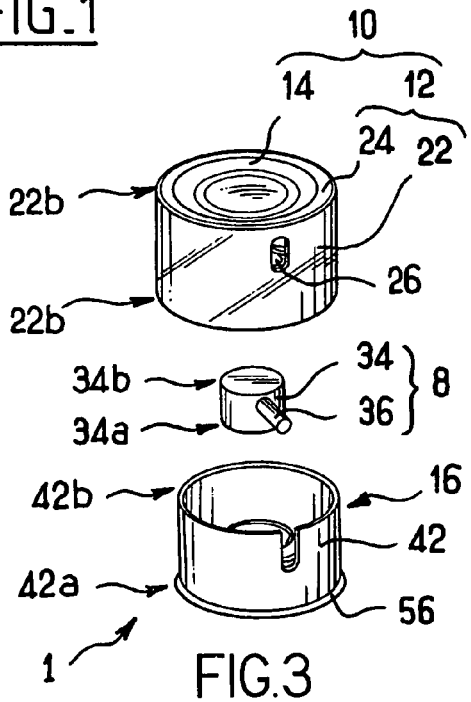
FIG. 3 is an exploded perspective view of the device only.
Figure 4:
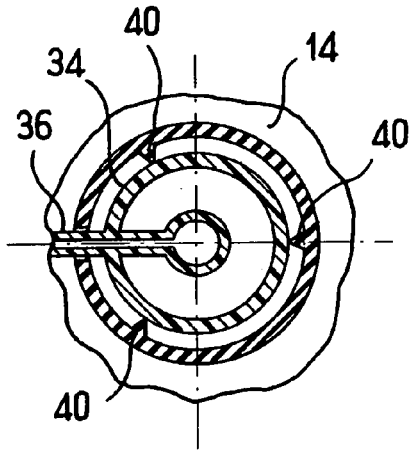
FIG. 4 is a view sectioned along line IV—IV in FIG. 1.

The illustrated assembly 2 comprises a capsule 1 which is fixed to a bottle 4 and a pump 6 in order to dispense a fluid which is contained in the bottle by means of the capsule 1.

The bottle 4 substantially comprises a container 50 which contains the fluid to be sprayed and a neck 20. The container 50 is substantially cylindrical and has a circular cross-section.

It extends in an extension direction 30 between a lower end 50*a* and an upper end 50*b*.

The pump 6 is crimped on the neck 20 of the bottle 4. It comprises an activation rod 52 which slides in the extension direction 30 in order to expel the fluid from the container 50.

The capsule 1 substantially comprises a push-button 8 which is mounted on the activation rod 52, a base element 16 which is fixed to the neck 20 of the bottle and a cap 10 which is fixed to the base element 16.

The push-button 8 substantially comprises a base 34 and a nozzle 36. The base 34 has a substantially cylindrical portion 33 and an upper portion in the form of a disc which forms a support surface 35. The cylindrical portion 33 extends in the extension direction 30 between a lower end 34*a* and an upper end 34*b*. The support surface 35 extends perpendicularly to the extension direction 30, at the upper end 34*b*. The nozzle 36 extends substantially perpendicularly to the extension direction 30 between an end 36*a* which communicates with the pump 6 and a free end 36*b*.

The base element 16 has flexible lugs 54 which are hooked right around the neck 20 of the bottle 4. It further has a substantially cylindrical passage 38 which extends in the extension direction 30 and in which at least the lower end 34*a* of the base 34 slides. The base element 16 further comprises a substantially cylindrical covering surface 42 which extends in the extension direction 30 between a lower end 42*a* and an upper end 42*b*. Finally, the base element 16 has an annular rim 56 which protrudes at the lower end 42*a* of the covering surface 42. This rim 56 holds a decorative strip 46 which surrounds and covers the covering surface 42. The decorative strip 46 is substantially tubular and is constituted by a strip of paper which is printed and wound about itself.

The cap 10 comprises a sleeve 12 and a flexible membrane 14. The sleeve 12 is produced from a substantially rigid transparent plastics material, advantageously of polypropylene. It comprises a tubular portion 22 which extends in the extension direction 30 between a lower end 22*a* and an upper end 22*b* and an inner rim 24 which extends substantially perpendicularly to the extension direction 30 from the upper end 22*b* of the tubular portion 22.

The tubular portion 22 extends in the extension of the container 50 and the lower end 22*a* of the tubular portion 22 extends in the immediate vicinity of the upper end 50*b* of the container, in such a manner that there is almost no opening or set-back between the capsule 1 and the container 50.

Furthermore, the tubular portion 22 is substantially opposite the covering surface 42 of the base element 16. The tubular portion 22 has, on the inner side, in the vicinity of the lower end 22*a* thereof, an annular beading 48 which is held by the annular rim 56. This annular beading 48 is fitted to the annular rim 56 by means of resilient deformation. The covering surface 42 further comes into abutment, at the upper end 42*b* thereof, against the inner rim 24. The covering surface 42 is consequently held between the inner rim 24 and the annular beading 48 in such a manner that the cap 10 is completely fixed to the base element 16.

Furthermore, owing to the presence of the rim 56, a tubular space 44, which encloses the decorative strip 46, extends between the tubular portion 22 and the covering surface 42 of the base element 16.

The tubular portion 22 comprises an opening 26 having an oblong shape which extends in the extension direction 30 and which receives the free end 36*b* of the nozzle 36.

The membrane 14 is in the form of a disc which has a peripheral edge 28 which is held in a sealing manner on the inner rim 24. It is advantageously produced from opaque thermoplastic elastomer material. It is moulded on the sleeve 16.

The membrane 14 has an outer face 14*a* and an inner face 14*b*. The inner face 14*b* is substantially in contact with the support surface 35 of the push-button 8. In this manner, by the outer face 14*b* of the membrane 14 being pressed and by the membrane 14 being slightly deformed, the support surface is pressed, the push-button 8 is made to slide in the passage 38 of the base element 16 and the pump 6 is activated.

Three positioning pins 40 protrude on the inner face 14*b* of the membrane 14 and surround the cylindrical portion 33 of the base 34 at the upper end 34*b* thereof. In this manner, even when the capsule 1 is mounted neither on a bottle, nor on a pump, the push-button 8 is completely held, at the lower end 34*a* of the base thereof, by the passage 38, at the upper end 34*b* of the base thereof, by the pins 40 and, at the free end 36*b* of the nozzle thereof, by the opening 26.

Finally, it will be appreciated that the base element 16 ends in the extension direction 30 between the lower end and the upper end 22*b* of the tubular portion 22 whilst push-button 8 is held substantially between the membrane and the base element 16. Consequently, the cap 10, which constituted by the membrane 14 and the inner rim 24 which extend perpendicularly to the extension direction 30 and tubular portion 22 which extends in the extension ection 30, defines a cavity 32 which completely encloses base element 16 and the push-button 8 in such a manner that the outer contour of the assembly 2 is defined only by container 50 and the cap 10.

What is claimed is:

1. Device which is intended to be fixed to a neck of a bottle in order to dispense a fluid, said device comprising:

a push-button which is intended to activate a pump, a base element which is intended to be fixed to the neck of the bottle, a cap comprising:

a sleeve of rigid plastics material, which sleeve is fixed to the base element and which has a tubular portion which extends in an extension direction between a lower end and an upper end, the tubular portion of the sleeve having, perpendicularly to the extension direction, an opening which is intended to allow the fluid which originates from the push-button to pass through, and a membrane of elastomer material, which membrane is substantially in the form of a disc and which extends substantially perpendicularly to the extension direction in the immediate vicinity of the push-button, said membrane having a peripheral edge which is fixed to the sleeve in a sealing manner in the vicinity of the upper end of said tubular portion, in such a manner that the cap defines a cavity, said cavity enclosing the base element and the push-button.

2. Device according to claim 1, wherein:

the push-button comprises:

a substantially cylindrical base which extends in the extension direction between a lower end and an upper end, and a nozzle which extends substantially perpendicularly to the extension direction into the opening, said base element has a passage which receives the base of the push-button, the membrane has an outer face which is intended to receive the finger of a user and an inner face which is opposite the base of the push-button and the membrane is provided with guiding elements which protrude on the inner face and which extend around the base of the push-button.

3. Device according to claim 1, wherein the membrane is overmolded on the sleeve.

4. Device according to claim 1, wherein the sleeve has a rim which extends substantially perpendicularly to the extension direction from the upper end of the tubular portion and the membrane is fixed to said rim.

5. Device according to claim 1, wherein the sleeve is substantially transparent and the base element has a substantially cylindrical covering surface which extends opposite the sleeve.

6. Device according to claim 5, wherein it has a tubular space between the sleeve and the covering surface, in which tubular space a decorative strip is arranged.

7. Device according to claim 1, wherein:

the sleeve has a rim which extends substantially perpendicularly to the extension direction from the upper end of the tubular portion and the membrane is fixed to said rim, the base element has a substantially cylindrical covering surface which extends opposite the sleeve, the sleeve has an annular beading and in that the base element is held between the rim of the sleeve and the annular beading.

8. Assembly comprising:

a bottle which comprises a neck and a cylindrical container which extends between a lower end and an upper end, a pump which is held on the neck of the bottle and which has an activation rod, a device according to claim 1, the push-button being mounted on the activation rod, the base element being fixed to the neck, the tubular portion of the sleeve extending in the extension of the cylindrical container, the tubular portion of the sleeve extending flush with the cylindrical container, the lower end of the tubular portion of the sleeve extending in the immediate vicinity of the upper end of the container.

* * * * *